US006322415B1

(12) United States Patent
Cyrus et al.

(10) Patent No.: US 6,322,415 B1
(45) **Date of Patent: *Nov. 27, 2001**

(54) TOY VEHICULAR ELECTROMAGNETIC GUIDANCE APPARATUS

(76) Inventors: Peter Cyrus, 1075 Summit Ave. E., Seattle, WA (US) 98102; Peter M. Maksymuk, IV, 80 First Ave., Apt. 15C; Leo M. Fernekes, 632 E. 11th St., Apt. 11, both of New York, NY (US) 10009; Stefan Rublowsky, 103 N. 8th St., Brooklyn, NY (US) 11211; Eduard Kogan, 84-29 153rd Ave., Apt. 2G, Howard Beach, NY (US) 11414; Scott J. Kolb, 235 2nd Ave., Apt. 1C, New York, NY (US) 10003; Eric S. Moore, 18 Spring St., Apt. #3, New York, NY (US) 10012; Dmitriy Yavid, 1735 61st St., 2nd Flr., Brooklyn, NY (US) 11204; Christopher S. Cosentino, 1 Peru St., Staten Island, NY (US) 10314

( * ) Notice: Subject to any disclaimer, the term of this patent is extended or adjusted under 35 U.S.C. 154(b) by 0 days.

This patent is subject to a terminal disclaimer.

(21) Appl. No.: 09/526,950

(22) Filed: Mar. 16, 2000

Related U.S. Application Data

(63) Continuation of application No. 08/943,545, filed on Oct. 3, 1997, now abandoned.

(51) Int. Cl.[7] ..... A63H 33/26

(52) U.S. Cl. ..... 446/130; 446/133; 446/136; 446/454; 463/63

(58) Field of Search ..... 446/129, 130, 446/133, 134, 135, 136, 444, 454, 455, 456; 463/58, 61, 63; 104/38, 47

(56) References Cited

U.S. PATENT DOCUMENTS

| | | | | |
|---|---|---|---|---|
| 2,106,424 | * | 1/1938 | Einfalt . | |
| 2,637,140 | * | 5/1953 | Hoff . | |
| 2,690,626 | * | 10/1954 | Gay et al. . | |
| 2,903,821 | * | 9/1959 | Favre . | |
| 2,920,420 | * | 1/1960 | Kolodziejski . | |
| 3,121,971 | * | 2/1964 | Nyc . | |
| 3,403,470 | * | 10/1968 | Werner . | |
| 3,453,970 | * | 7/1969 | Hansen . | |
| 3,584,410 | * | 6/1971 | Lalonde . | |
| 3,596,401 | * | 8/1971 | Camire . | |
| 3,734,433 | * | 5/1973 | Metzner . | |
| 5,087,001 | * | 2/1992 | Bolli et al. . | |
| 5,601,490 | * | 2/1997 | Nakagawa et al. | 463/63 |
| 5,865,661 | * | 2/1999 | Cyrus et al. | 446/136 |
| 6,007,401 | * | 12/1999 | Cyrus et al. | 446/175 |
| 6,012,957 | * | 1/2000 | Cyrus et al. | 446/175 |
| 6,102,770 | * | 8/2000 | Cyrus et al. | 446/444 |

FOREIGN PATENT DOCUMENTS

| | | | | |
|---|---|---|---|---|
| 2674141 | * | 9/1992 | (FR) . | |
| 673321 | * | 6/1952 | (GB) | 446/444 |

* cited by examiner

*Primary Examiner*—Kien T. Nguyen

(57) ABSTRACT

The present invention is a guidance apparatus for movable toy vehicles that includes a track, or roadway, on which the toy vehicles move. The truck has an intersection. The intersection has a magnetic guidance mechanism for steering the toy vehicles in alternate directions through the intersection. An intersection magnetic sensing mechanism, i.e., electromagnets at the intersection and magnets in the vehicles, stops the vehicles prior to entering the intersection. Additionally, the vehicles stopped at the intersection can be actuated by a timing mechanism after passage of a predetermined time period. Furthermore, the vehicles stopped at the intersection can be actuated only after a mechanism for sensing vehicle presence in the intersection senses no vehicles in the intersection.

25 Claims, 16 Drawing Sheets

TOY VEHICULAR ELECTROMAGNETIC GUIDANCE APPARATUS

RELATED APPLICATION(S) INFORMATION

This is a continuation of U.S. application Ser. No. 08/943,545, filed Oct. 3, 1997 now abandoned, the disclosure of which is hereby expressly incorporated by reference.

FIELD OF THE INVENTION

The invention relates to the guidance of toy vehicles and, more particularly, electromagnetic guidance thereof on a predefined track.

BACKGROUND OF THE INVENTION

U.S. Pat. No. 1,084,370 discloses an educational apparatus having a transparent sheet of glass laid over a map or other illustration sheet that is employed as a surface on which small moveable figures are guided by the movement of a magnet situated below the illustration sheet. Each figure, with its appropriate index word, figure or image is intended to arrive at an appropriate destination on the top of the sheet and to be left there temporarily.

U.S. Pat. No. 2,036,076 discloses a toy or game in which a miniature setting includes inanimate objects placeable in a multitude of orientations on a game board and also includes animate objects having magnets on their bottom portions. A magnet under the game board is employed to invisibly cause the movement of any of the selected animate objects relative to inanimate objects.

U.S. Pat. No. 2,637,140 teaches a toy vehicular system in which magnetic vehicles travel over a toy landscape as they follow the movement of ferromagnetic pellets through an endless nonmagnetic tube containing a viscous liquid such as carbon tetrachloride. The magnetic attraction between the vehicles and ferromagnetic pellets carried by the circulating liquid is sufficient to pull the vehicles along the path defined by the tube or channel beneath the playing surface.

U.S. Pat. No. 3,045,393 teaches a device with magnetically moved pieces. Game pieces are magnetically moved on a board by reciprocation under the board of a control slide carrying magnetic areas or elements longitudinally spaced apart in the general direction of the motion path. The surface pieces advance step-by-step in one direction as a result of the back and forth reciprocation of the underlying control slide.

U.S. Pat. No. 4,990,117 discloses a magnetic force-guided traveling toy wherein a toy vehicles travels on the surface of a board, following a path of magnetically attracted material. The toy vehicles has single drive wheel located centrally on the bottom of the vehicle's body. The center of the gravity of the vehicle resides substantially over the single drive wheel so that the vehicles is balanced. A magnet located on the front of the vehicles is attracted to the magnetic path on the travel board. The magnetic attraction directly steers the vehicle around the central drive wheel along the path.

SUMMARY OF THE INVENTION

The present invention is a guidance apparatus for moveable toy vehicles that includes a track, or roadway, on which the toy vehicles move. The track has one, and preferably more than one, intersection. The intersection has a magnetic guidance mechanism for steering the toy vehicles in alternate directions through the intersection. An intersection magnetic sensing mechanism, electromagnets at the intersection and magnets in the vehicles, stops the vehicles prior to entering the intersection. Additionally, the vehicles stopped at the intersection can be actuated by a timing mechanism after passage of a predetermined time period. Furthermore, the vehicles stopped at the intersection can be actuated only after a mechanism for sensing vehicle presence in the intersection senses no vehicles in the intersection. Preferably, the guidance mechanism for steering toy vehicles through an intersection includes an electromagnet under each roadway of the intersection. Each electromagnet has a pair of poles that straddle the path of the toy vehicle. The toy vehicle has a magnet on its undersurface. Each of the electromagnets under the roadways is actuatable for current to flow in each of two directions through the electromagnet for each of the two poles of the electromagnet to be either a positive or a negative pole. The two poles of each electromagnet can thus either attract or repel the pole of the magnet on the underside of the vehicle, depending on the direction of current flow through the electromagnet. Since the two poles of the electromagnet straddle the path of the toy vehicle, when energized, one pole will attract and the other pole will repel the vehicle magnet to guide the vehicle in a first direction (i.e., right). Reversing the current through the electromagnet reverses the polarity of the two poles, thus guiding the vehicle in the opposite direction. No current flow through the electromagnet results in no magnetic interaction with the vehicle, and the vehicle proceeds straight.

Preferably, a surface roadway is located over the track or roadway described above. Additionally, a surface toy vehicle is movable on the surface roadway in reaction to movement under this surface toy vehicle of the toy vehicle (i.e., powered subsurface vehicle) on the track or roadway under the surface roadway. Each powered subsurface vehicle has a motor therein and a collision avoidance mechanism. The collision avoidance mechanism includes a magnet on the rear of each of the subsurface vehicles and a magnetic field sensor on the front of each of the subsurface vehicles. The magnetic field sensor is adapted to de-energize the power source of the associated subsurface vehicle when the magnetic field sensor senses the magnetic field of the magnet of another subsurface vehicle located ahead of the subsurface vehicle. In this manner, following subsurface vehicles stop prior to impact with leading subsurface vehicles. A similar type of Hall effect system, with a magnet on the vehicles and a sensor adjacent the intersection can determine when a vehicle is approaching the intersection. A vehicle approaching an intersection can be stopped by one of the electromagnets adjacent each roadway that function to electromagnetically block intersection access on command.

Preferably, guidance of the toy vehicles through the intersection can be accomplished with a remote control that provides vehicle guidance instructions to the electromagnetic guidance mechanism of the intersection. Alternatively, the electromagnetic guidance mechanism of the intersection can be preprogrammed to guide the toy vehicles through the intersection on, for example, a random basis.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
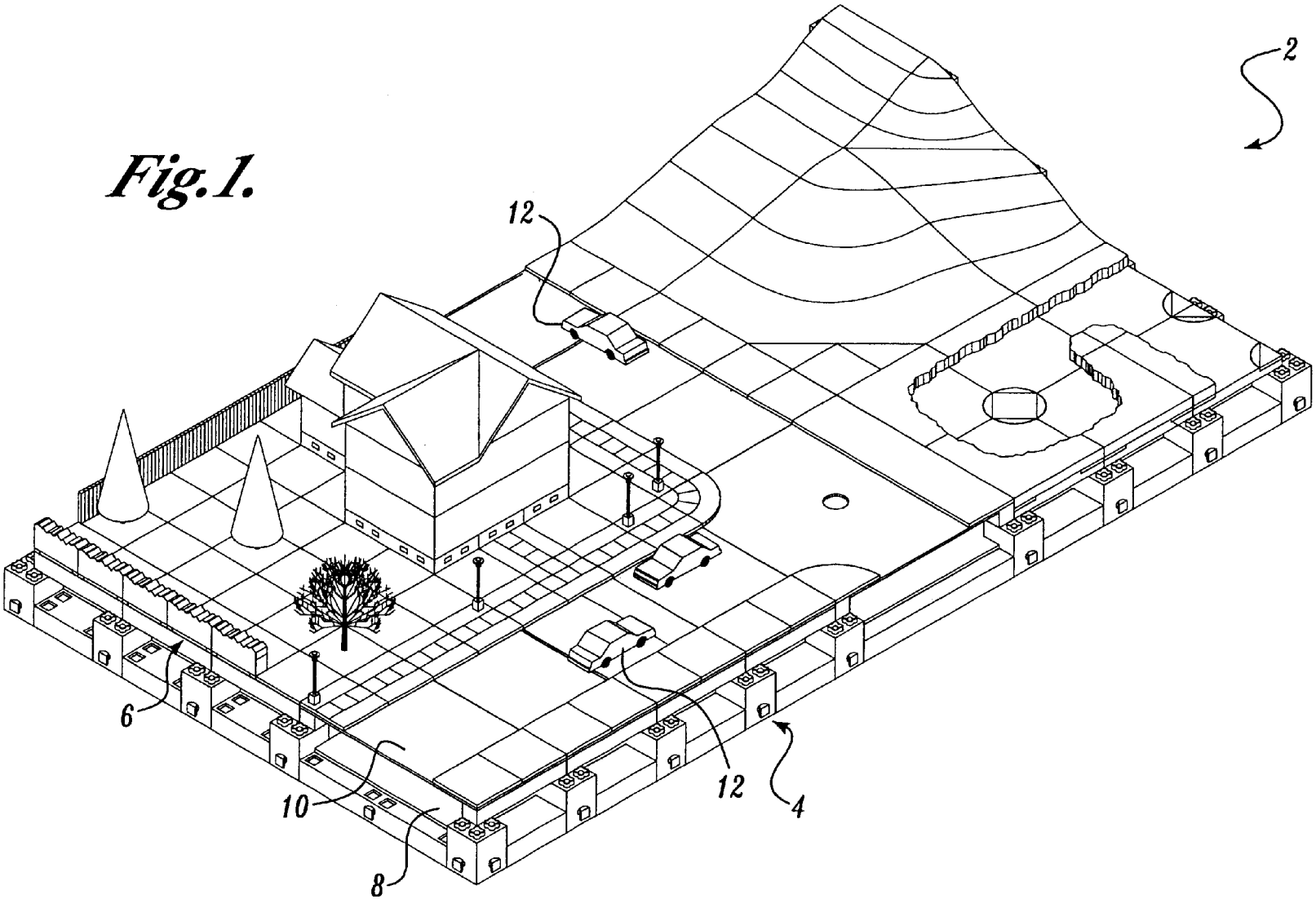
FIG. 1 is an isometric view of a toy building set including the upper roadway and lower roadway of the present invention.
Figure 2:
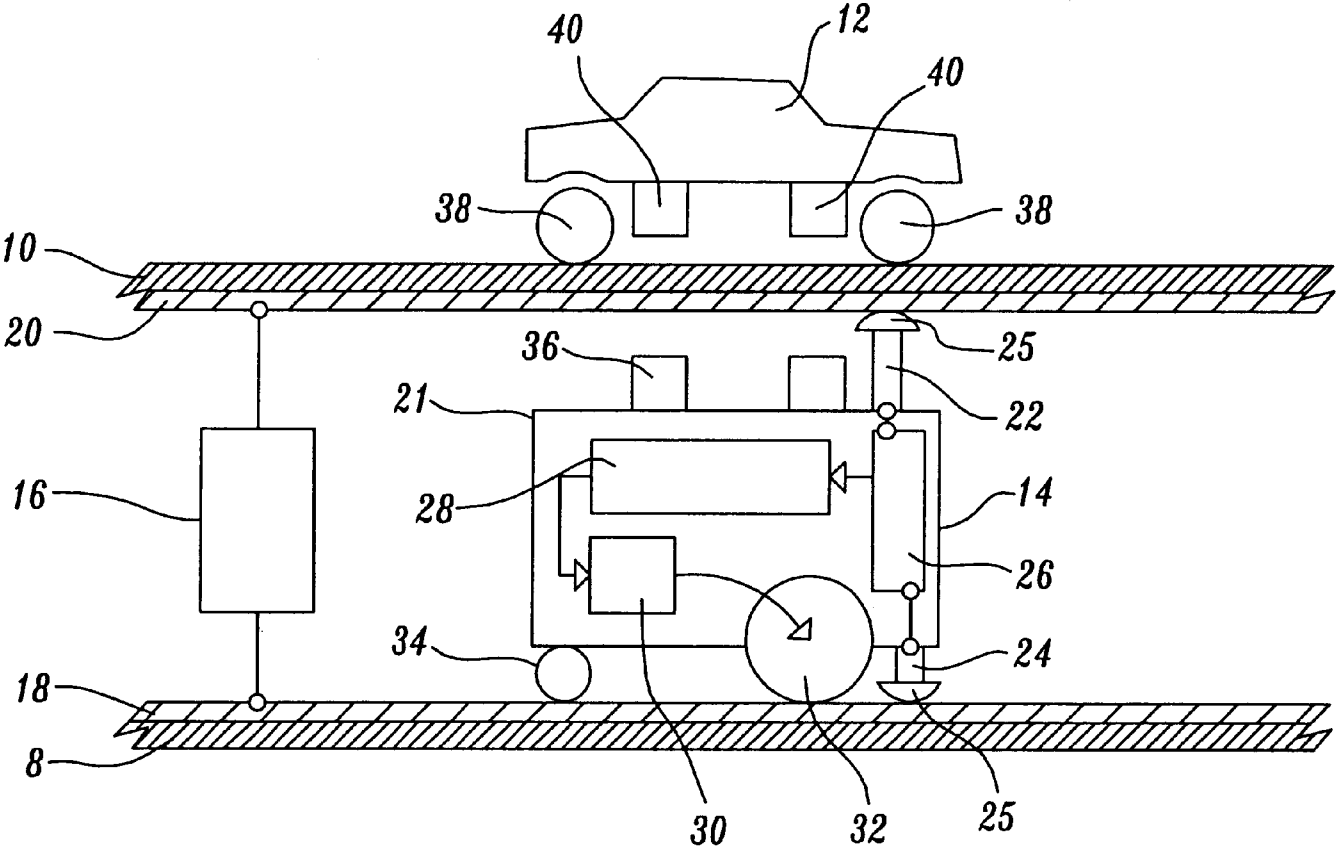
FIG. 2 is a diagrammatic section view of the upper roadway, lower roadway, surface vehicle and powered subsurface vehicle of the present invention.
Figure 3:
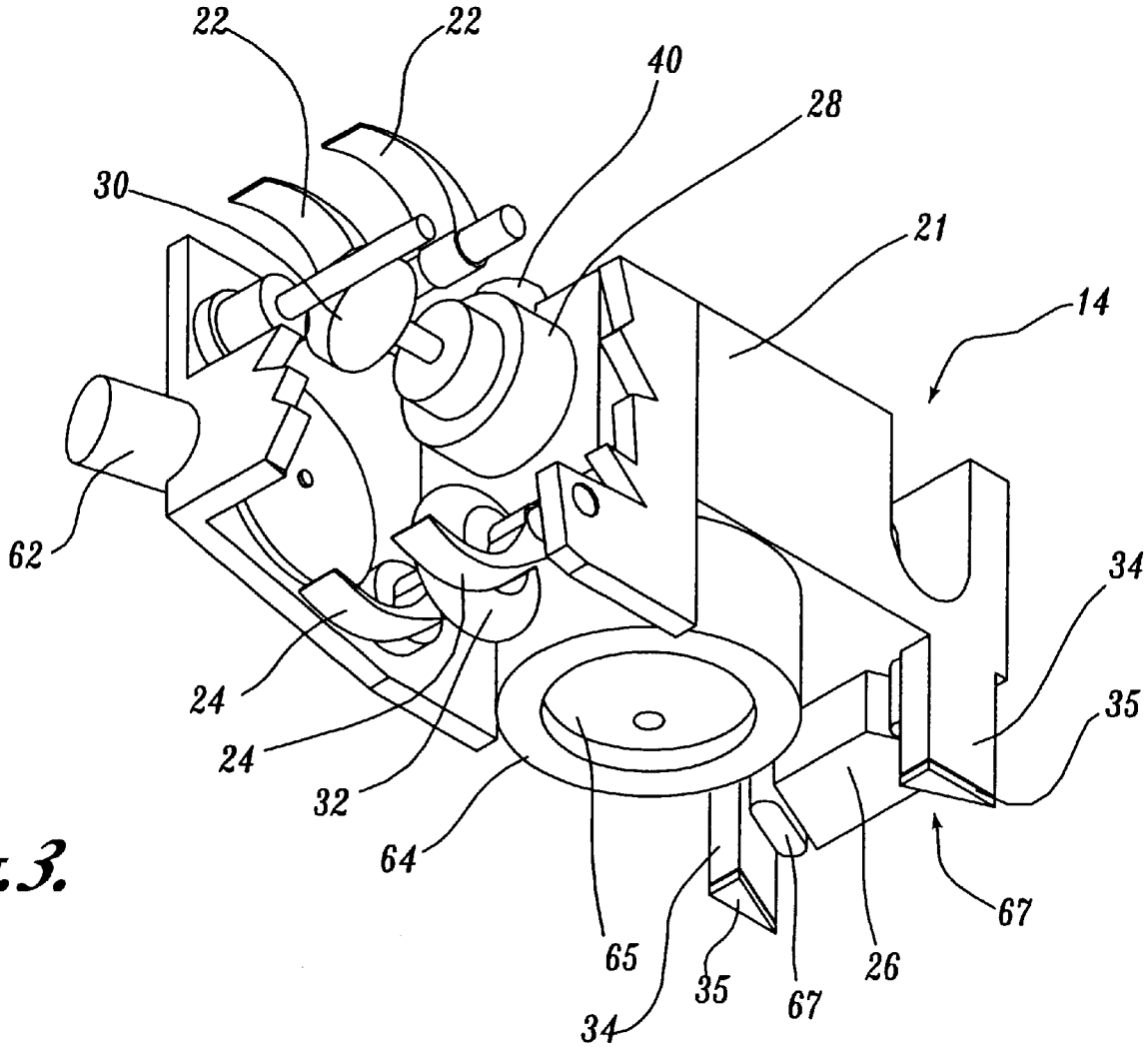
FIG. 3 is a partially exposed isometric view of the powered subsurface vehicle of the present invention.

The present invention is a toy vehicular electromagnetic guidance apparatus as shown and described in FIGS. 1–16. As best shown in FIG. 1, the toy vehicular guidance apparatus of the present invention can be used in a toy building set 2 having a lattice 4 and modular bases 6. More specifically, lattice 4 provides the substructure of toy building set 2 and supports modular bases 6 which are spaced above lattice 4 by a predetermined distance. Lower roadway 8 is also supported by lattice 4, but on a lower portion of lattice 4 at a predetermined distance below modular bases 6. Upper roadway 10 is comprised of some of modular bases 6 that have been specialized in design to provide a smooth traffic bearing surface for movement of surface vehicles 12 thereon. Most preferably, the road pattern of upper roadway 10 and lower roadway 8 are identical so that subsurface vehicles 14, as shown in FIGS. 2 and 3, can travel on lower roadway 8 to guide surface vehicles 12 on upper roadway 10 in a manner further described below. Preferably, the distance between lower roadway 8 secured to lattice 4 and upper roadway 10, also secured to lattice 4, is large enough to allow ingress and travel of subsurface vehicle 14 between lower roadway 8 and upper roadway 10.

Next referring to FIG. 2, the magnetic interconnection between surface vehicle 12 and subsurface vehicle 14 is shown whereby subsurface vehicle 14 travels between lower roadway 8 and upper roadway 10 such that surface vehicle 12 can be transported on upper roadway 10 by subsurface vehicle 14. As shown in FIG. 2, power supply 16 interconnects a lower conductive layer 18 and upper conductive layer 20. Lower conductive layer 18 is located on the upper side of lower roadway 8. Upper conductive layer 20 is located on the under side of upper roadway 10. Power supply 16 thus energizes lower conductive layer 18 and upper conductive layer 20. Subsurface vehicle 14 accesses the electrical power in lower conductive layer 18 and upper conductive layer 20 in a manner described below to travel on lower roadway 8. Power supply 16 can be either direct current or alternating current, of preferably a shock safe voltage level, for example, about 12 volts. Lower conductive layer 18 and upper conductive layer 20 consist of thin metal sheets, foil layers or a conductive coating that may be, for example, polymeric. The conductive sheet, coating, or composite most preferably includes copper as the conductive metal.

Still referring to FIG. 2, subsurface vehicle 14 has a chassis 21 with an upper brush 22 located on the top of chassis 21 adjacent the under side of upper roadway 10 on which upper conductive layer 20 is located. Chassis 21 also has a lower brush 24 located on the under side thereof adjacent the upper surface of lower roadway 8 on which lower conductive layer 18 is located. Upper brush 22 and lower brush 24, which can be metal, graphite or conductive plastic, provide electrical interconnection between chassis 21 of subsurface vehicle 14 and upper conductive layer 20 and lower conductive layer 18, respectively for transfer of electrical power from power supply 16 to subsurface vehicle 14. Upper brush 22 and lower brush 24 are preferably elastic or spring loaded in order to accommodate changes in the distance between upper conductive layer 20 and lower conductive layer 18 to ensure a reliable electrical connection to subsurface vehicle 14. Upper brush 22 and lower brush 24 each have a head 25 that is contoured, or in another way shaped, for low friction sliding along upper conductive layer 20 and lower conductive layer 18 respectively, when subsurface vehicle 14 is in motion. Lower conductive layer 18 and upper conductive layer 20 can be located on substantially the entire upper surface of lower roadway 8 and under side of upper roadway 10, respectively, in order to ensure electrical interconnection of subsurface vehicle 14 to power supply 16 despite lateral movement across lower conductive layer 18 and upper conductive layer 20 by subsurface vehicle 14 due to, for example, turning of subsurface vehicle 14 or uncontrolled lateral movement thereof. Alternatively, lower conductive layer 18 and upper conductive layer 20 can be located in troughs or grooves in the upper surface of lower roadway 8 and the under side of upper roadway 10, respectively, into which head 25 of lower brush 24 and head 25 of upper brush 22, respectively, can reside in order to control the tracking of subsurface vehicle 14 in an electrically conductive environment by minimizing lateral movement of subsurface vehicle 14 relative to lower roadway 8 and upper roadway 10. Upper brush 22 and lower brush 24 are both electrically connected to control circuit 26 that is located on the front of chassis 21 of subsurface vehicle 14. Generally, control circuit 26 controls the electrical functioning of subsurface vehicle 14, and more specifically controls, and is electrically interconnected with, electromotor 28. Control circuit 26 thus controls the direction of movement, acceleration, deceleration, stopping, and turning of subsurface vehicle 14 based on external control signals, or control signals generated by subsurface vehicle 14 itself. Control circuit 26 is described in further detail below in conjunction with FIG. 8. Electromotor 28, electrically interconnected with control circuit 26, can be a direct current motor with brushes, a direct current brushless motor, or a stepper motor. Electromotor 28 is mechanically interconnected with transmission 30 that transfers rotation of electromotor 28 to drive wheel 32 employing the desired reduction ratio. More than one electromotor 28 can be employed for independent drive of a plurality of drive wheels 32. Additionally, transmission 30 can be a differential transmission to drive two or more drive wheels 32 at different speeds. In this manner, more sophisticated control of the acceleration, deceleration, and turning, for example, of subsurface vehicle 14 can be employed. Chassis support 34 is located on the under side of chassis 21 of subsurface vehicle 14. Chassis support 34 is spaced from drive wheel 32, also located on the under side of subsurface vehicle 14, and can be, for example, rollers or low friction drag plates that are preferably flexible to allow compensation for distance variation between lower roadway 8 and upper roadway 10. Magnets 36 are preferably disposed on the top of subsurface vehicle 14 adjacent the under side of upper roadway 10. Magnets 36 are preferably permanent magnets, but can also be electromagnets supplied with power from power supply 16 via control circuit 26.

Still referring to FIG. 2, surface vehicle 12, while preferably being a car, truck, or other vehicle, can be any type of device for which mobility is desired in the environment of a toy building set. Surface vehicle 12 includes wheels 38 which are rotatable to allow movement of surface vehicle 12 on upper roadway 10. Instead of wheels 38, a low friction drag plate can be employed. Magnets 40 are located on the under side of vehicle 12 adjacent upper roadway 10. Magnets 40 are sized and spaced on vehicle 12 to be aligned with magnets 36 on the top of chassis 21 of subsurface vehicle 14 for magnetic interconnection of surface vehicle 12 and subsurface vehicle 14. Magnets 36 are 0.1×0.125 inch round permanent rare earth magnets with residual flux around 9,000 Gauss. Preferably, the same type of magnets are employed for magnets 40 of surface vehicle 12. Reliable magnetic coupling has been observed at a distance of up to 0.2 inches between magnets 40 of surface vehicle 12 and magnets 36 of subsurface vehicle 14.

Next referring to FIG. 3, a preferred embodiment of subsurface vehicle 14 is shown. Subsurface vehicle 14 of FIG. 3 is designed to move between an ABS lower roadway 8 and with a lower conductive layer 18 and an ABS upper roadway 10 with an upper conductive layer 20. Subsurface vehicle 14 of FIG. 3 has one drive wheel 32 and two chassis supports 34 having low friction pads 35. Two upper brushes 22 and two lower brushes 24 are preferably present and are made from copper. Upper brushes 22 and lower brushes 24 are loaded by torsion springs. The above configuration assures a substantially uniform force on drive wheel 32 regardless of the clearance between lower roadway 8 and upper roadway 10, and also facilitates passage of subsurface vehicle 14 along inclines or declines of lower roadway 8 and upper roadway 10. Two rear magnets 62 are located on chassis 21 for collision avoidance with another subsurface vehicle 14 as described further below. Electromotor 28 is preferably a direct current brush motor, for example, Namiki model No. 10CL-1202, rated for 0.22 W maximum output at approximately 17,000 RPM at 4.5 volts of direct current power supply. Transmission 30 consists of a Namiki 100A gear train blocked with motor 28 along with a crown gear and associated pinions. The total reduction ratio of transmission 30 is 1:40, and the efficiency is about 25 percent. Subsurface vehicle 14 operates at speeds of up to 9 inches per second at an incline of up to 15°. Lower magnet 64, on the underside of chassis 21, guides subsurface vehicle 14, and associated surface vehicle 12, on lower roadway 8, and causes subsurface vehicle 14, and associated vehicle 12, to turn based on magnetic interaction with electromagnetic direction controllers adjacent lower roadway 8 described in further detail below. Lower magnet 64 is preferably conic shaped with a protruding tip and is most preferably a 0.5×0.2 inch permanent rare earth magnet with a residual flux of about 9,000 Gauss. The protruding tip 65 of lower magnet 64 is preferably steel for more precise guidance on lower roadway 8. A pair of Hall effect sensors 67 straddle control circuit 26 on the front of chassis 21 for control of surface vehicle 14 in a manner further described below.

Figure 4:
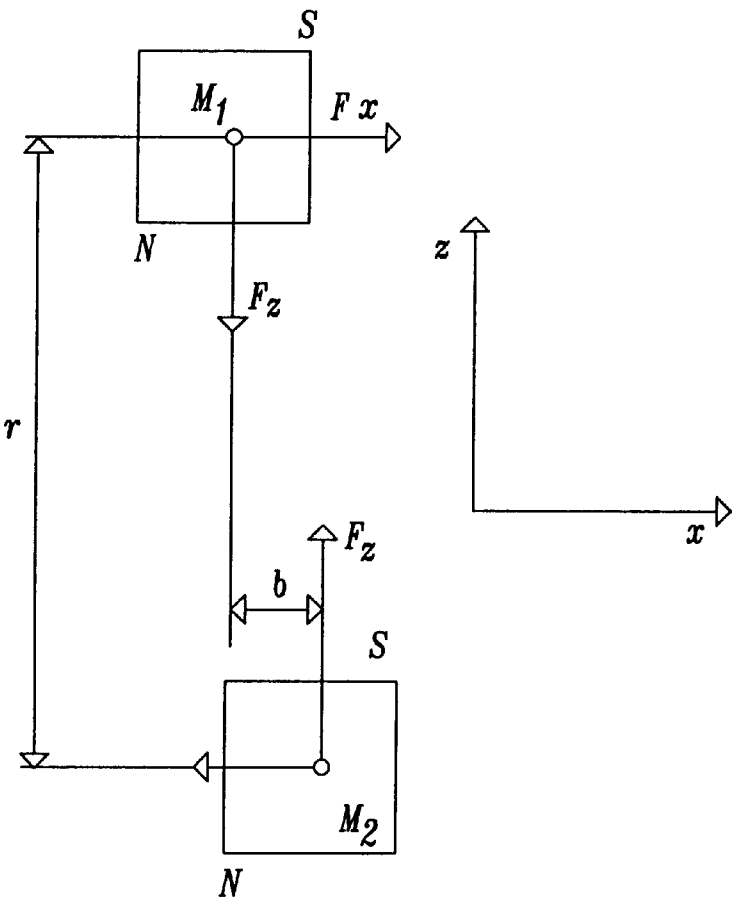
FIG. 4 is a diagrammatic section view of attractive forces between two magnets showing no offset.

Next referring to FIGS. 4–7, the principles of the magnetic forces interconnecting surface vehicle 12 and subsurface vehicle 14 by magnets 36 and magnets 40 are described. As shown in FIG. 4, when two magnets are placed one above the other, with opposite poles toward each other, a magnetic force $F_z$ between them exhibits based on the following equation:

$$F_z \approx 6\,\frac{M_1 \cdot M_2}{r^4}$$

where r is the distance between parallel planes in which magnets are situated and $M_1$, $M_2$ are magnetic moments of both magnets. For permanent magnets, M is proportional to the volume of magnetic substance cross its residual flux density. For electromagnets, M is proportional to the number of turns cross the current.

Figure 5:
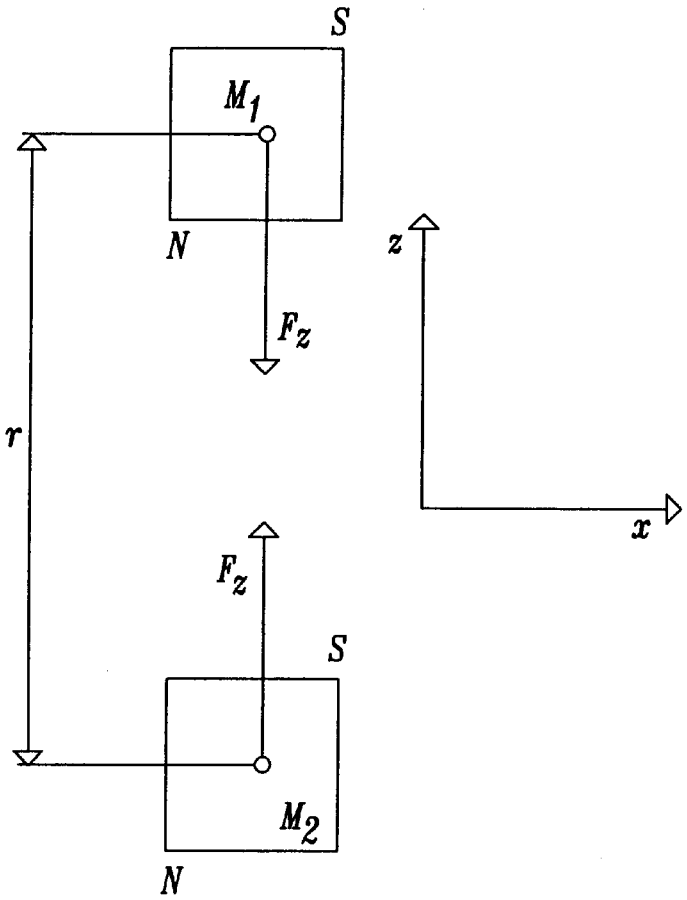
FIG. 5 is a diagrammatic section view of attractive forces between two magnets showing horizontal offset.

As shown in FIG. 5, when two magnets, one above the other, are shifted slightly to be horizontally offset by a distance b, the horizontal force $F_x$ occurs:

$$F_x \approx 6b\frac{M_1 \cdot M_2}{r^5}$$

Figure 6:
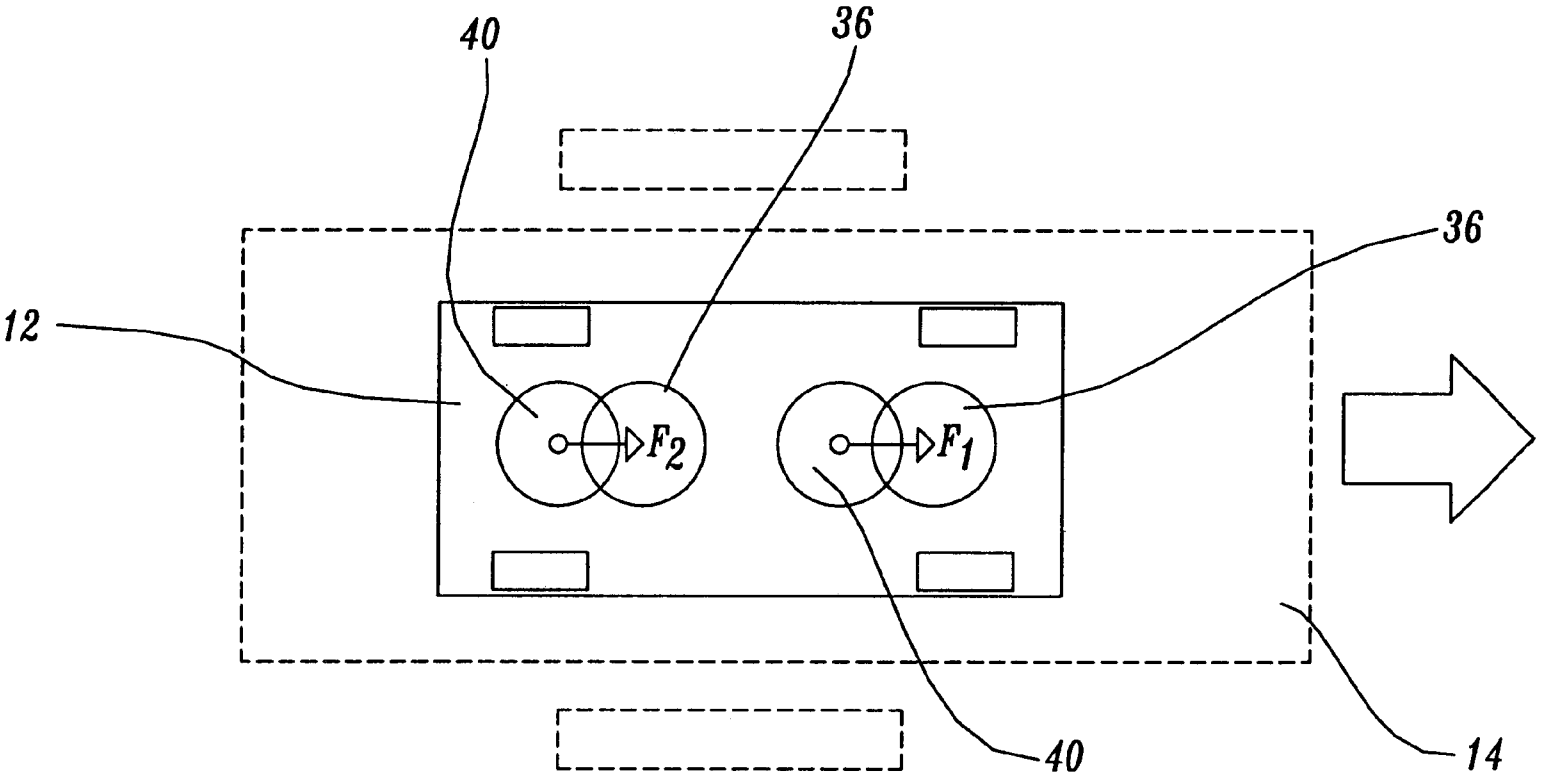
FIG. 6 is a diagrammatic plan view of the magnetic interaction between the surfaces vehicle and the subsurface vehicle of the present invention during straight movement.
Figure 7:
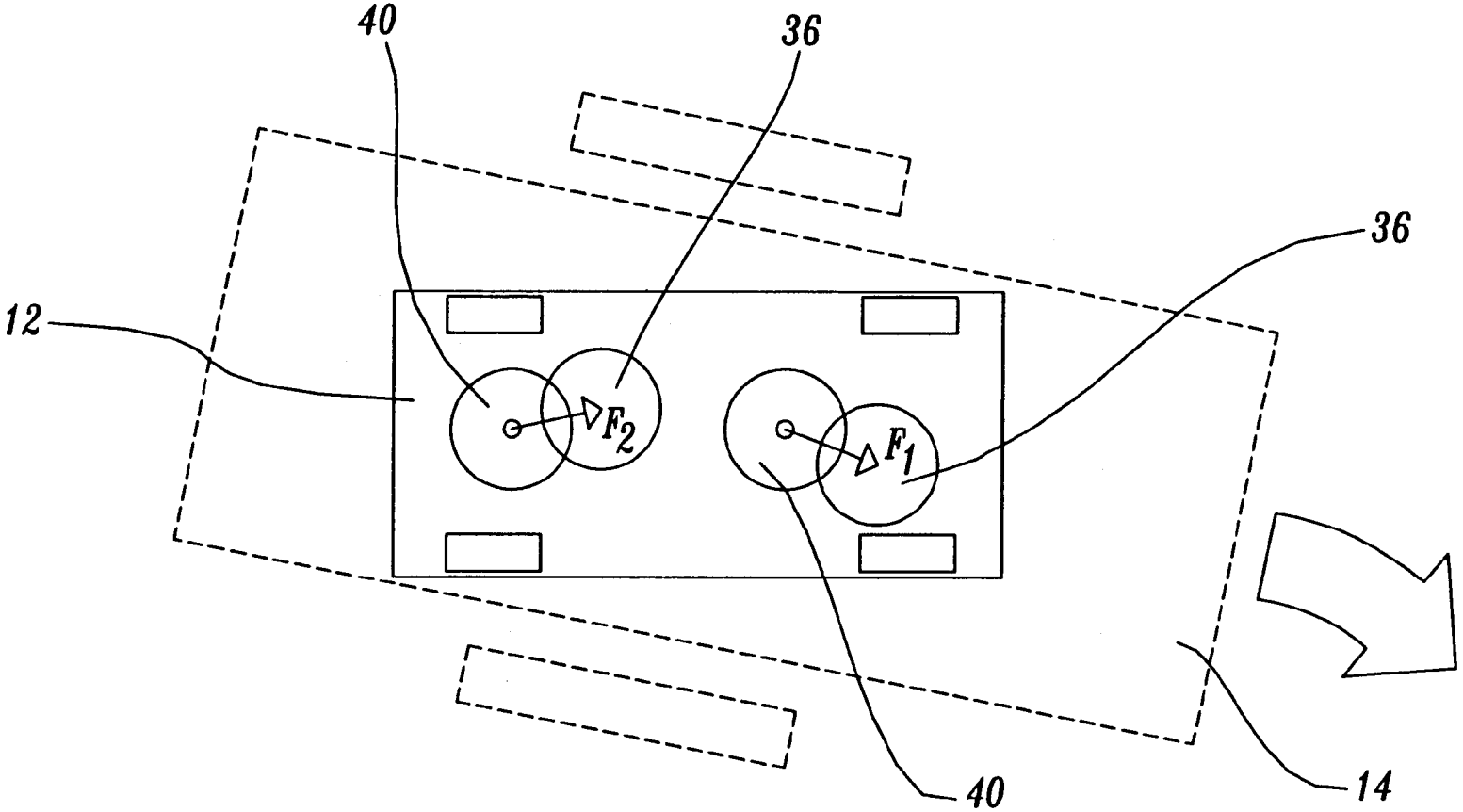
FIG. 7 is a diagrammatic plan view of the magnetic interaction between the surface vehicle and the subsurface vehicle of the present invention during a turn.

Next referring to FIGS. 6 and 7, the principles described above and shown in FIGS. 4 and 5 are discussed in relation to movement of nonpowered surface vehicle 12 by powered subsurface vehicle 14 due to the magnetic interconnection between magnets 40 of surface vehicle 12 and magnets 36 of subsurface vehicle 14. First referring to FIG. 6, during straight line movement, the horizontal offset between surface vehicle 12 and subsurface vehicle 14 increases as subsurface vehicle 14 moves until forces $F_1$ and $F_2$ become large enough to overcome friction, inertia and, possibly, gravitational incline. At this point, surface vehicle 12 moves to follow subsurface vehicle 14. During a turn, as shown in FIG. 7, forces $F_1$ and $F_2$ have different directional vectors. Thus, forces $F_1$ and $F_2$ not only create thrust, but torque as well, that causes surface vehicle 12 to follow subsurface vehicle 14.

Figure 8:
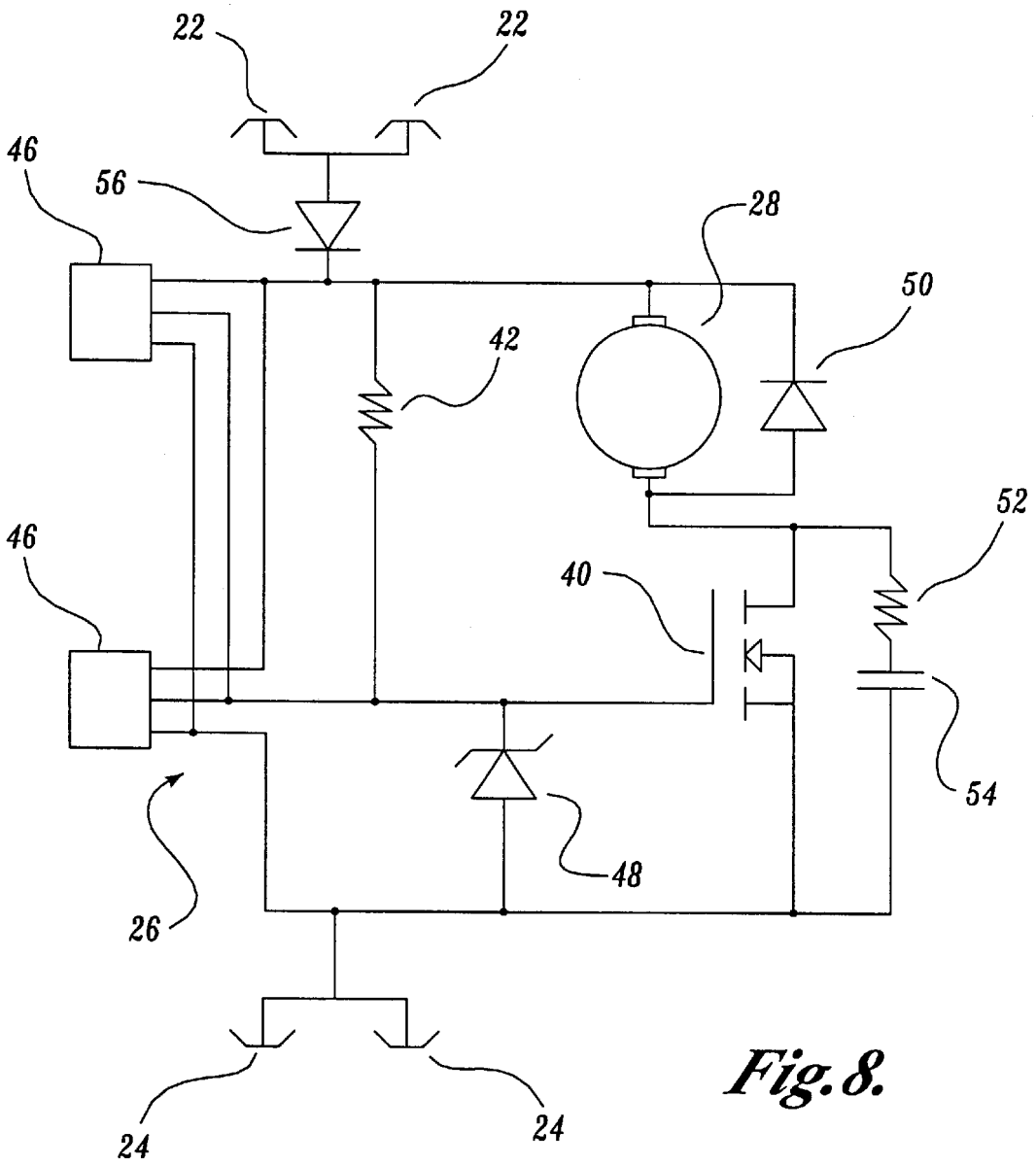
FIG. 8 is an electrical schematic of the control circuit of the subsurface vehicle of the present invention.
Figure 9:
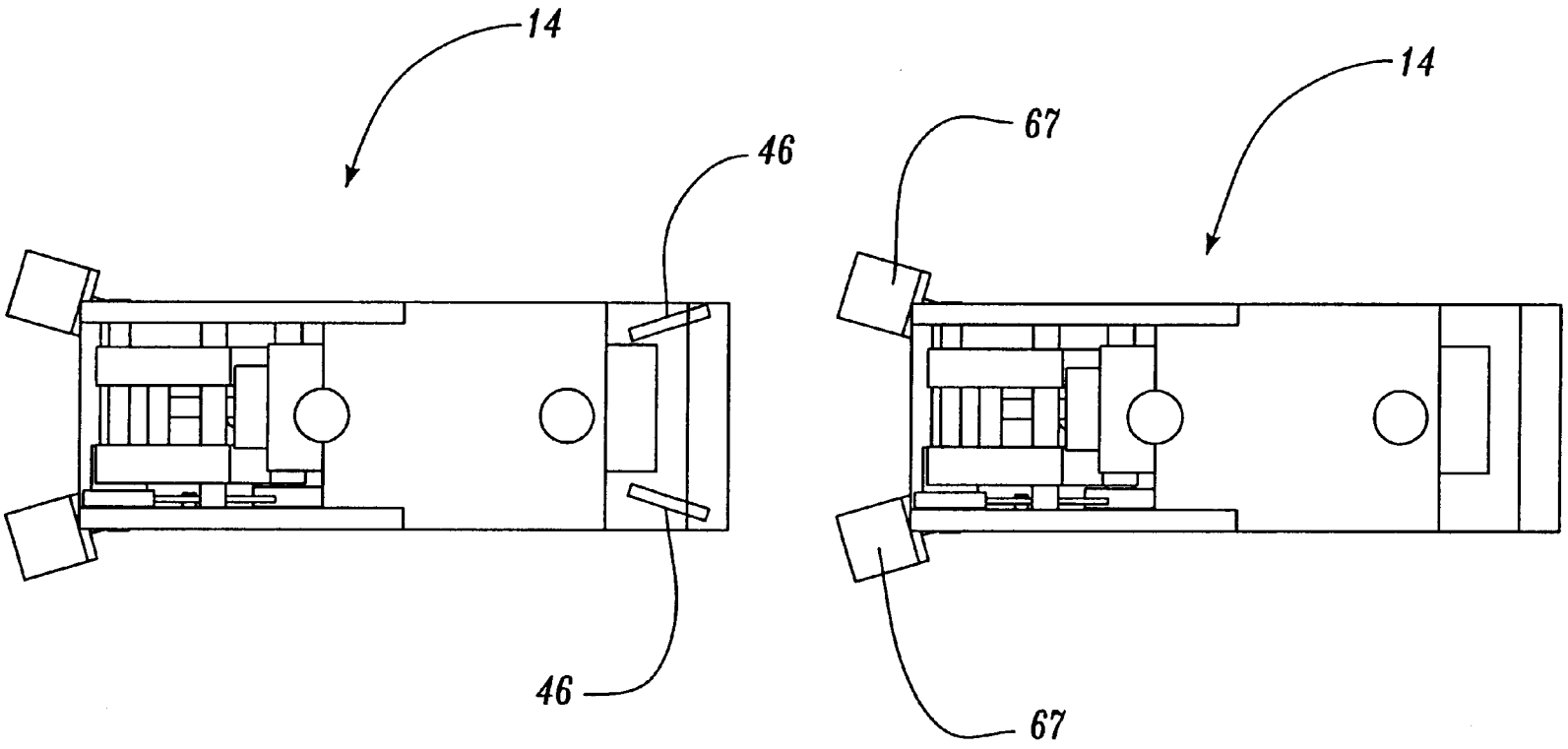
FIG. 9 is a plan view of a leading subsurface vehicle and a following subsurface vehicle showing collision avoidance thereof.

Now referring to FIG. 8, control circuit 26 is described in further detail. Control circuit 26 is electrically connected to both upper brushes 22 and lower brushes 24. Control circuit includes an FET 40 (for example, model No. ZVN4206A manufactured by Zetex) that is normally open because of 10 k Ohm pull-up resistor 42. However, FET 40 deactivates electromotor 28 if a magnetic control or collision signal is detected by a Hall effect sensor 46 (element 67 of FIG. 3) as further described below. Zener diode 48 (for example, model no. 1N5242 manufactured by Liteon Power Semiconductor) prevents overvoltage of the gate of FET 40. Diode 50 (for example, model no. 1N4448 manufactured by National Semiconductor), as well as an RC-chain consisting of 100 Ohm resistor 52 and 0.1 mcF capacitor 54, protect control circuit 26 from inductive spikes from electromotor 28. Diode 56 (for example, model no. 1N4004 manufactured by Motorola) protects control circuit 26 from reverse polarity of power supply 16. As shown in FIG. 9, Hall effect sensor 46 (element 67 of FIG. 9) of control circuit 26 is employed to prevent a rear end collision between a leading and a following subsurface vehicle 14. Control circuit 26 is preferably located on the front of following subsurface vehicle 14 so that Hall effect sensor 67 will be in close proximity to the magnetic field of rear magnet 62 of leading subsurface vehicle 14. When the following subsurface vehicle 14 closes to a predetermined distance, the magnetic field of rear magnet 62 of leading subsurface vehicle 14 is sensed by Hall effect sensor 67. Hall effect sensor 67 causes FET 40 to deactivate electromotor 28, thus stopping the following subsurface vehicle 14. When the leading subsurface vehicle 14 moves away from the following subsurface vehicle 14, the increased distance therebetween removes the magnetic field of rear magnet 62 of leading subsurface vehicle 14 from proximity to Hall effect sensor 67 of following subsurface vehicle 14. FET 40 thus activates electromotor 28 for movement of following subsurface vehicle 14.

Figure 10:
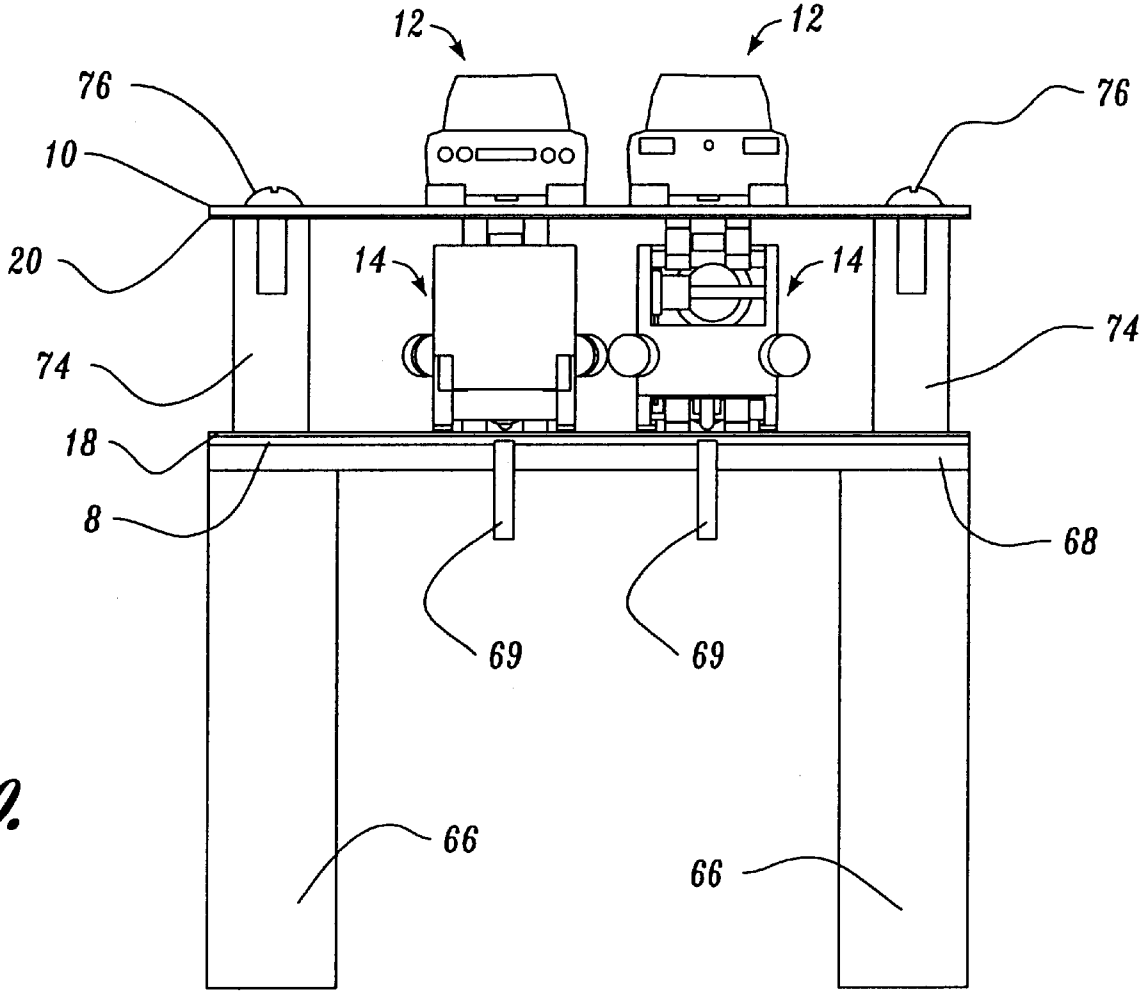
FIG. 10 is a transverse section view of the upper roadway, lower roadway, two surface vehicles and two powered subsurface vehicles of the present invention.
Figure 11:
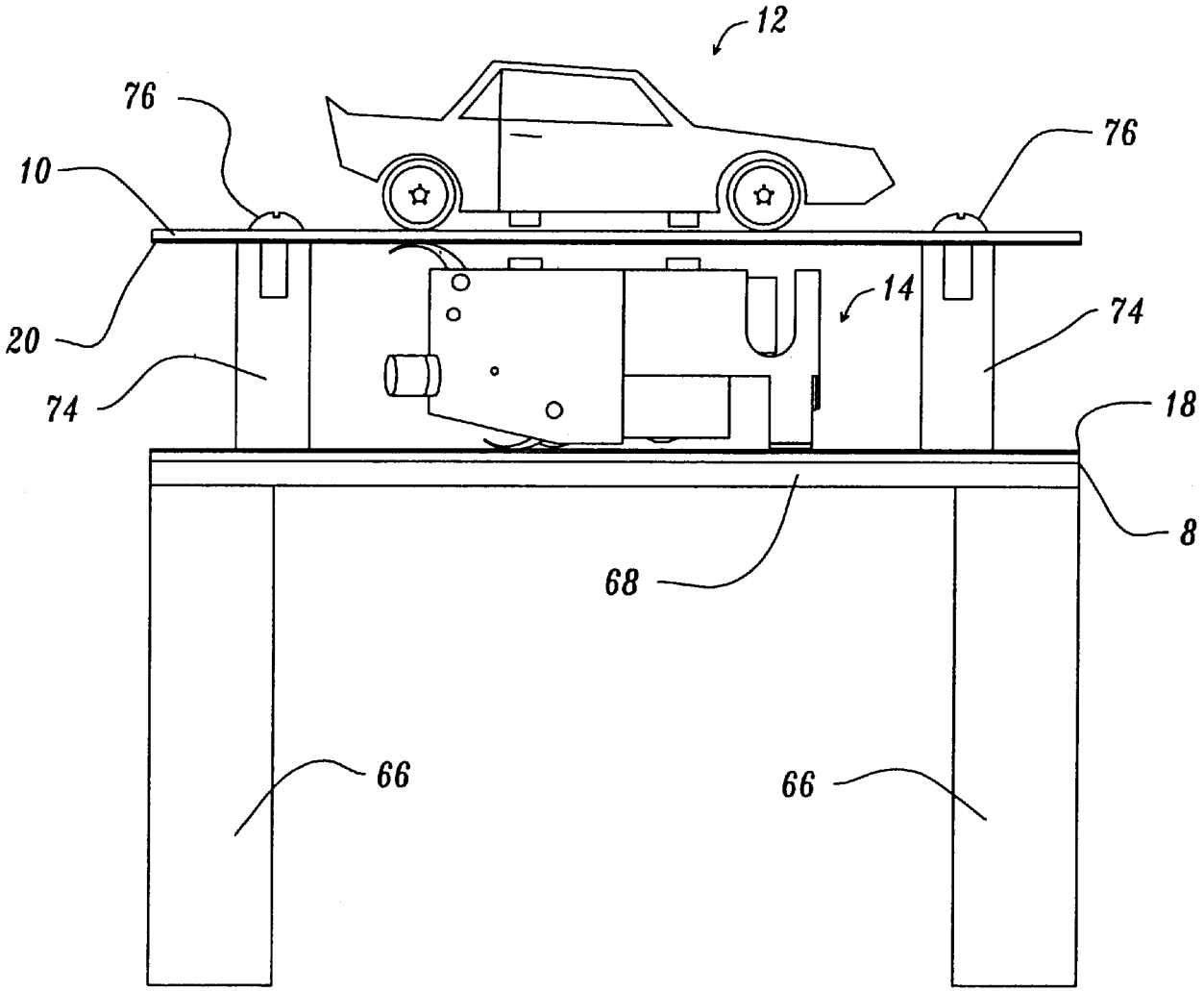
FIG. 11 is a diagrammatic side section view of the upper roadway, lower roadway, surface vehicle and powered subsurface vehicle of the present invention.
Figure 12:
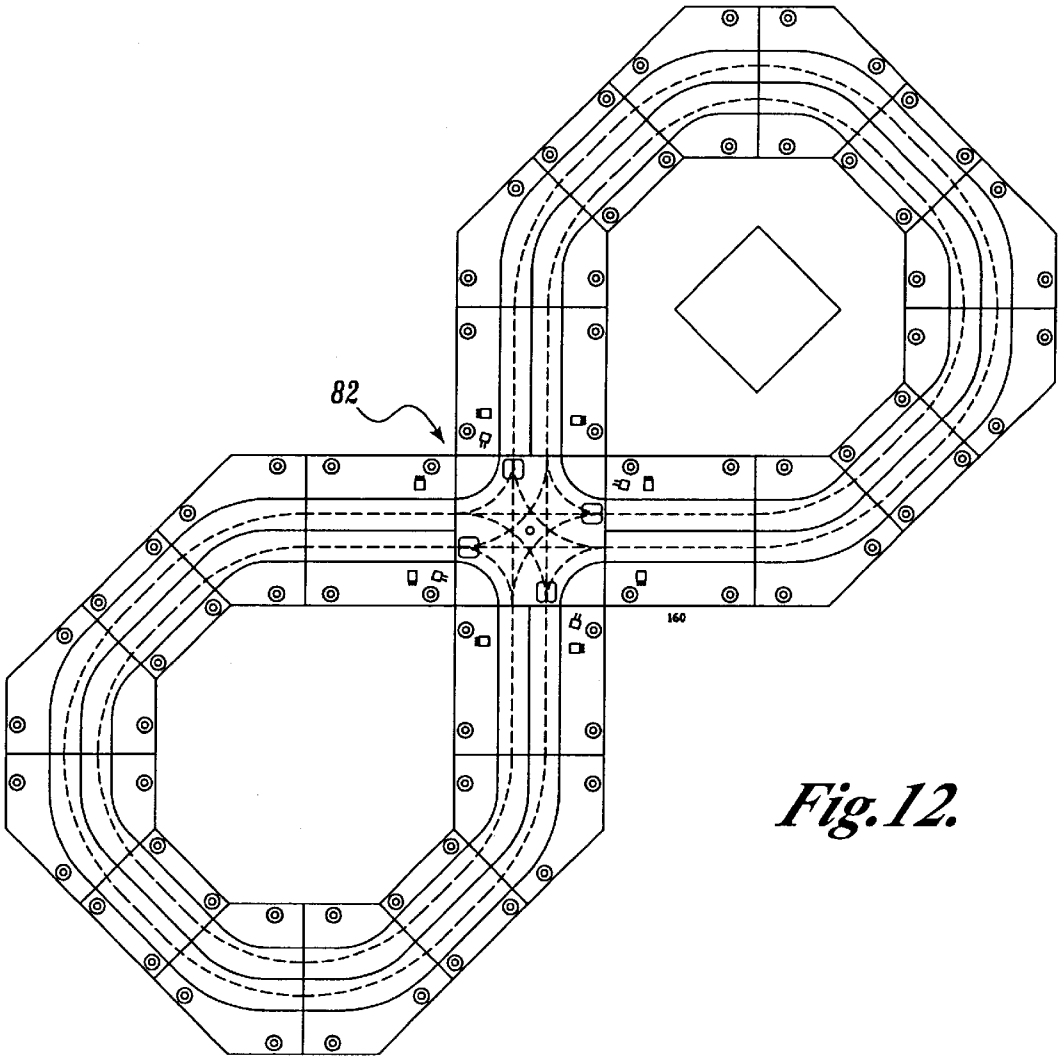
FIG. 12 is a plan view of the lower roadway of the present invention with electromagnetic direction controllers.

Next referring to FIGS. 10 and 11, further structural detail of one embodiment of lower roadway 8 and upper roadway 10, between which subsurface vehicle 14 travels, is shown. Lower vertical supports 66 are aligned in two spaced apart sets to support horizontal plate 68, which is preferably comprised of aluminum or other metal alloy. Horizontal plate 68 is the foundation for lower roadway 8, which is preferably comprised of ABS. As stated above, lower conductive layer 18, comprised of nickel or other conductive material, is located on lower roadway 8. Lower brushes 24 are in electrical communication with lower conductive layer 18. Thus, longitudinal steel strip 69 passes through horizontal plate 68 and is nested in lower roadway 8 at a sufficient depth such that lower magnet 64, and specifically steel tip 65 thereof, is attracted to steel strip 69 for guidance of subsurface vehicle 14. Upper vertical supports 74 are preferably spaced apart in two sets. On the upper ends of upper vertical supports 74 is upper roadway 10, having upper conductive layer 20, preferably made of nickel or other conductive alloy, on its underside. Bolts 76 are employed to removably secure upper roadway 10 and upper conductive layer 20 to upper vertical supports 74. Upper vertical supports 74 preferably have a height precisely defined to allow electrical communication between lower brushes 24 of subsurface vehicle 14 and lower conductive layer 18, as well as between upper brushes 22 of subsurface vehicle 14 and upper conductive layer 20.

Figure 13A:
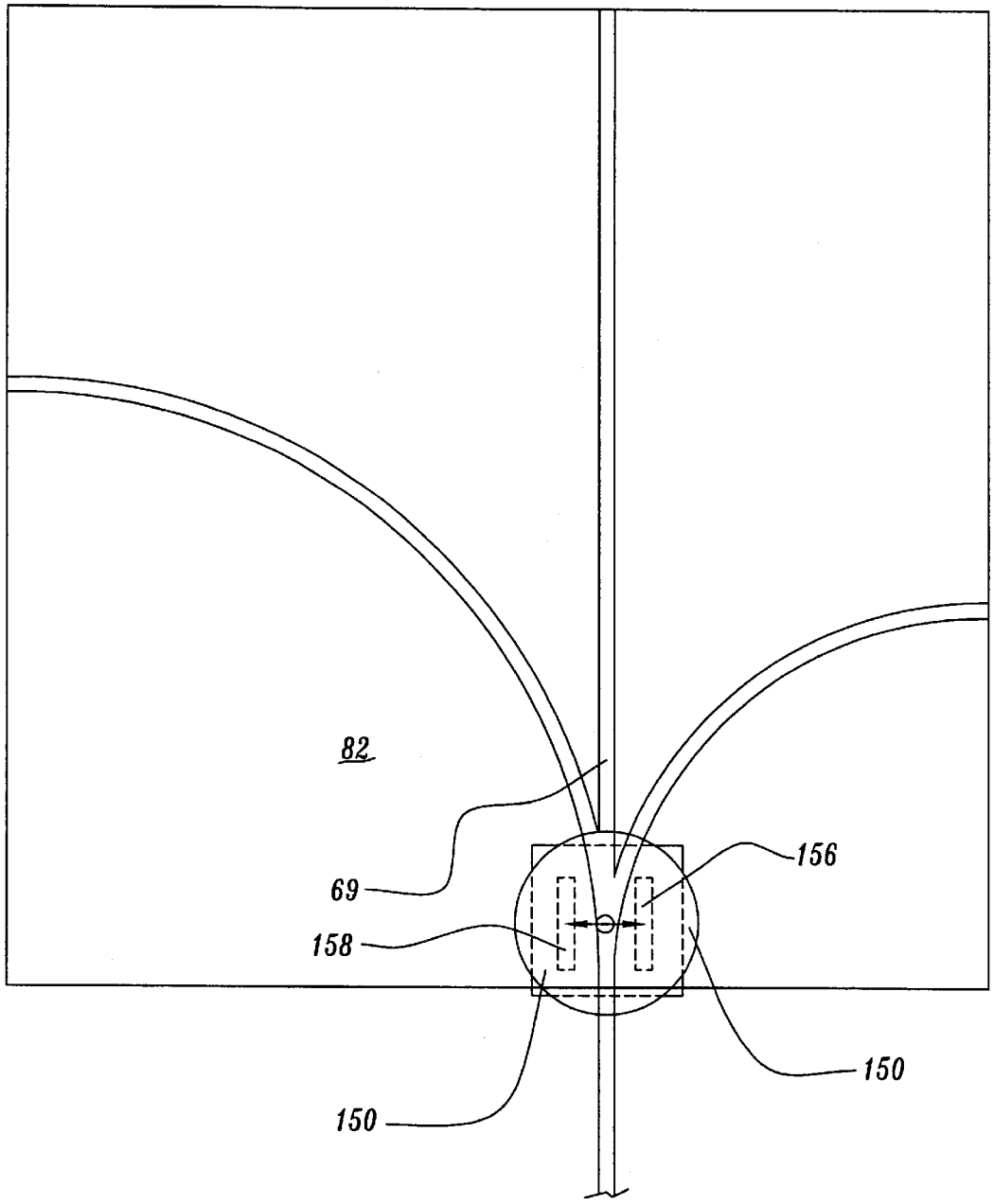
FIG. 13A is a detail view of the electromagnetic direction controllers of FIG. 12.
Figure 13B:
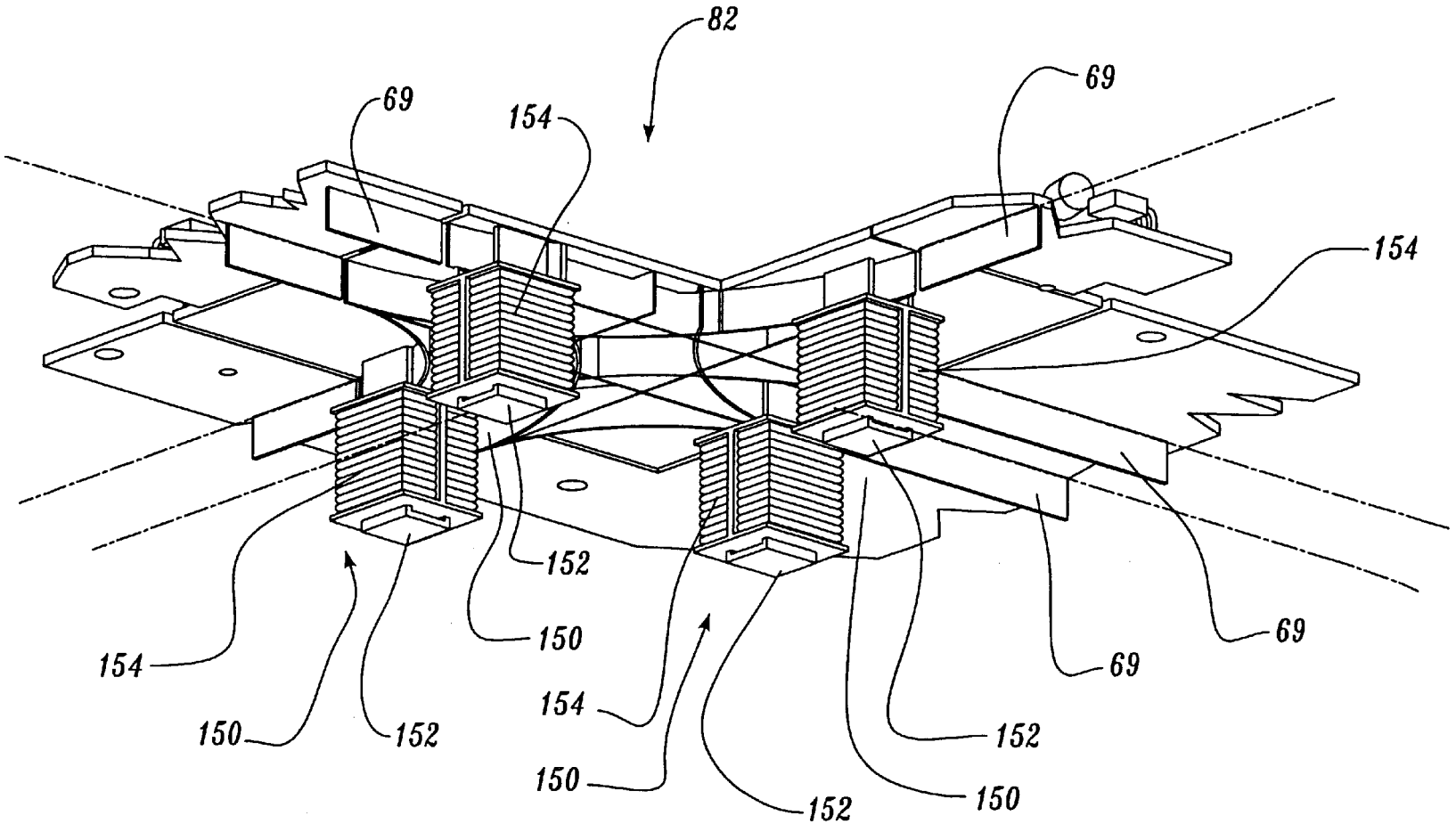
FIG. 13B is a partially exposed isometric view of the electromagnetic direction controllers of FIG. 12.

Referring to FIGS. 12, 13A, 13B and 14, intersection 82 and the electromagnetic direction control components thereof are shown in detail. As best shown in FIGS. 13A and 13B, an electromagnet 150 is located under each lower roadway 8 where the lower roadway 8 joins with intersection 82. Each electromagnet 150 is comprised of a U-shaped core 152 with a two section coil 154 thereon. U-shaped core 152 is preferably comprised of low carbon steel and coil 154 is preferably comprised of about 4,000 turns of #40 copper wire. Each electromagnet 150 is connected to an electric power source known in the art such that current in two alternating directions can selectively be passed through coil 154. In this manner, poles 156 and 158 of U-shaped core 152, which straddle steel strip 69, can be configured with either pole 156 being positive and pole 158 being negative, or pole 156 being negative and pole 158 being positive. Poles 156 and 158 can thus either attract or repel the pole of lower magnet 64 of subsurface vehicle 14 adjacent steel strip 69, depending upon the direction of current flow through electromagnet 150 that has been selected. With current flowing through electromagnet 150 in a first direction, pole 156 will thus attract lower magnet 64 of subsurface vehicle 14 and pole 158 will repel lower magnet 64 to guide subsurface vehicle 14 in a first direction, i.e., right. Reversing the direction of the current through electromagnet 150 will cause pole 156 to repel lower magnet 64 and pole 158 to attract lower magnet 64 to guide subsurface vehicle 14 in a second direction, i.e., left. No current flow through electromagnet 150 results in no magnetic interaction of poles 156 and 158 with lower magnet 64, and subsurface vehicle 14 proceeds straight.

Figure 14:
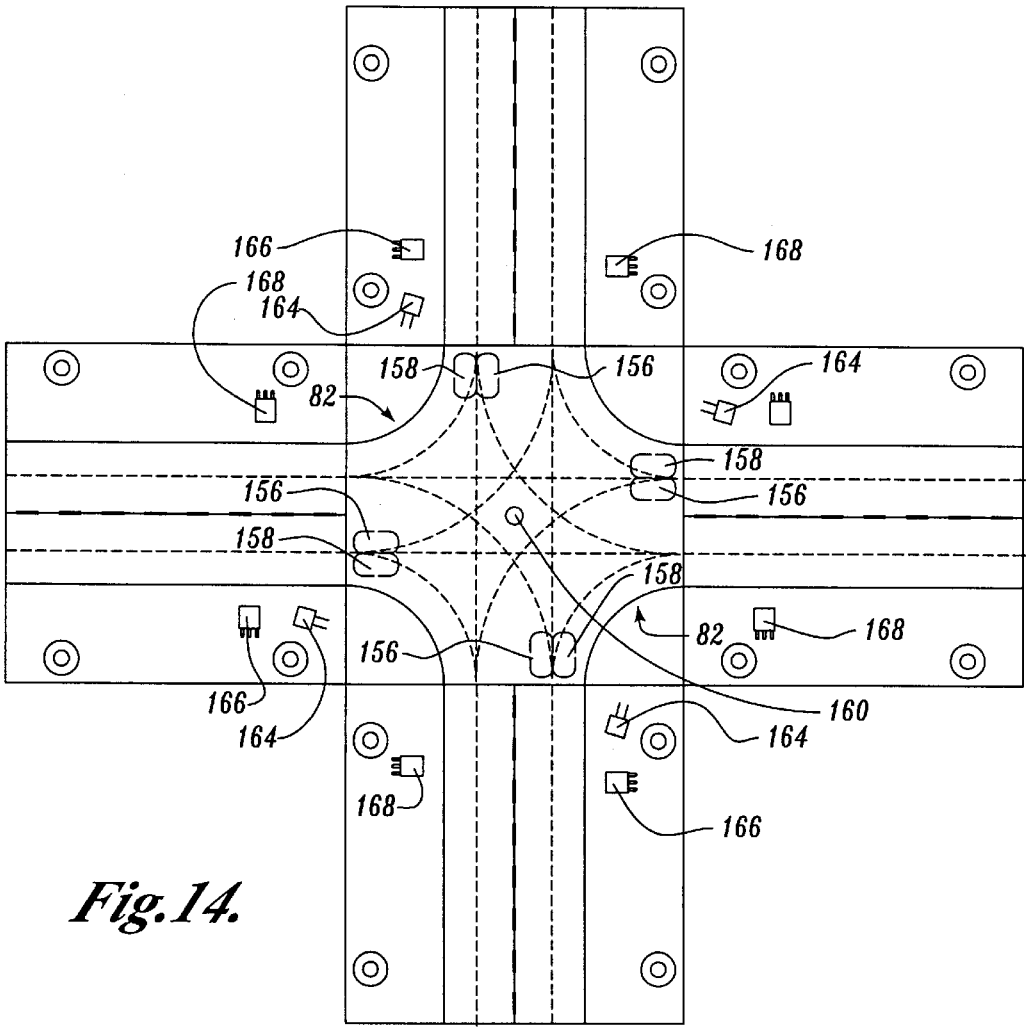
FIG. 14 is a detail plan view of FIG. 12 showing the electromagnetic direction controllers of the present invention.

As shown in FIG. 14, in addition to electromagnet 150 and associated poles 156 and 158, each intersection 82 includes a laser detector 160 that is actuatable by a remote control unit. When actuated, laser detector 160 causes infrared sensor 162 (shown in FIG. 12) of this specific intersection 82 to receive infrared control commands from a remote control unit to selectively control the electromagnets 150 as well as stop coils 164 of the specific intersection 82. Stop coils 164 are electromagnets located on each lower roadway 8 adjacent intersection 82 that, when energized, actuate Hall effect sensors 67 to deactivate motor 28 of subsurface vehicle 14, thus stopping subsurface vehicle 14 prior to entering intersection 82 in order to control multiple vehicle traffic. Hall effect sensors 166, located on each lower roadway 8 adjacent intersection 82, detect when a subsurface vehicle 14 is approaching intersection 82. Hall effect sensors 168 also located on each lower roadway 8 adjacent intersection 82, detect when a subsurface vehicle 14 has left intersection 82. The data from laser detector 160, infrared sensor 162, Hall effect sensors 166 and Hall effect sensors 168 are fed to microprocessor U1 of FIG. 16 to control intersection traffic, as described below.

Figure 15:
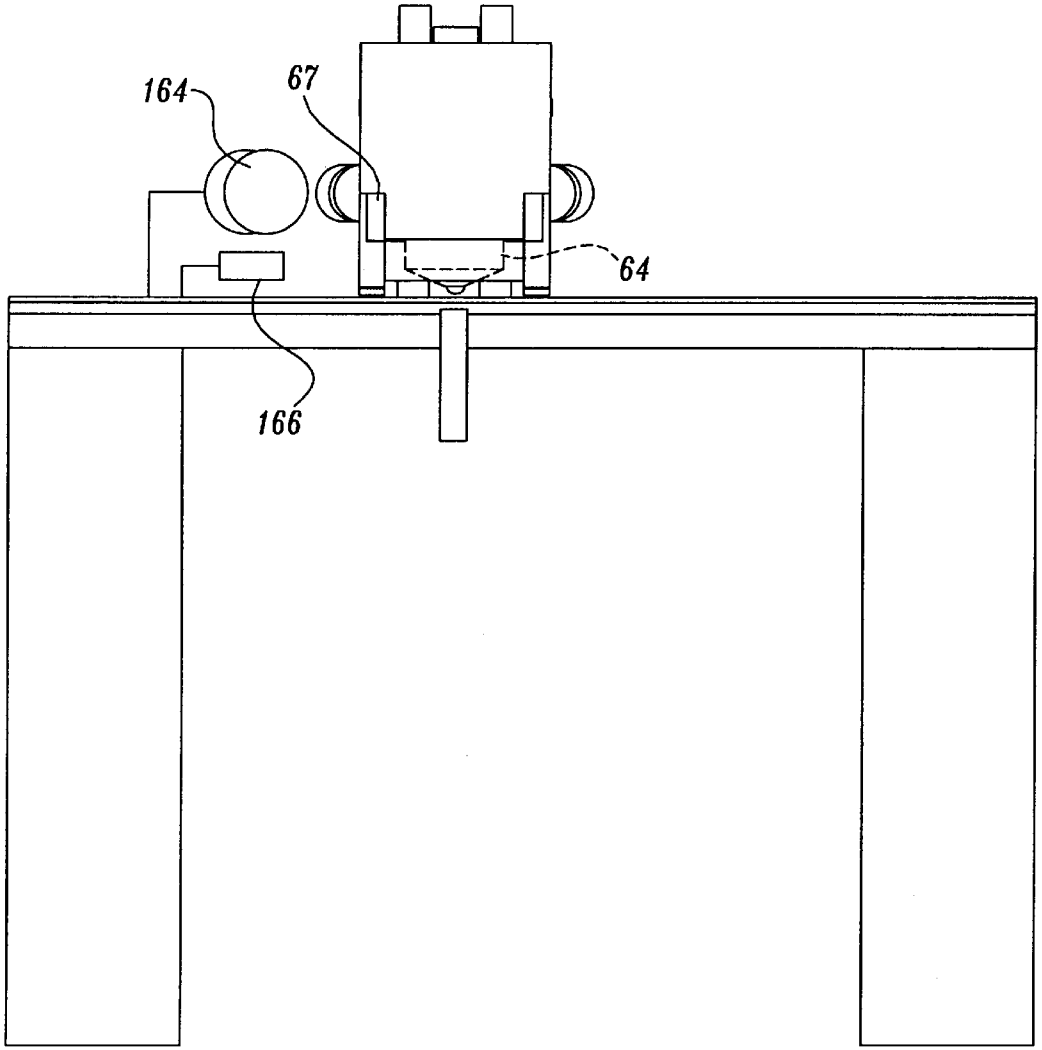
FIG. 15 is a diagrammatic section view of the interaction between the guidance control elements located adjacent an intersection and on the subsurface vehicle of the present invention.

Referring to FIG. 15, the orientation of stop coil 164, Hall effect sensor 166 and Hall effect sensor 168 proximate to Hall effect sensor 167 and lower magnet 64 of subsurface vehicle 14 is shown. Hall effect sensor 166 adjacent intersection 82 senses lower magnet 64 of approaching subsurface vehicle 14. This data is processed by microprocessor U1 of FIG. 16, below, to activate stop coil 164. Stop coil 164 triggers Hall effect sensor 67 of subsurface vehicle 14 to deactivate motor 28, thus stopping subsurface vehicle before it enters intersection 82. Hall effect sensor 168 detects lower magnet 64 of a subsurface vehicle 14 as it leaves intersection 82 and relays this data to microprocessor U1. The above interaction between stop coils 164, Hall effect sensor 166, Hall effect sensor 67, lower magnet 64 and microprocessor U1 ensures that after one subsurface vehicle 14 has entered intersection 82, all other subsurface vehicles 14 are detained until that subsurface vehicle 14 has left intersection 82.

The above electromagnetic direction controllers of the present invention can be employed in a random mode whereby a Hall effect sensor 166 of a lower roadway 8 senses the approach of a subsurface vehicle 14, as described above. Microprocessor U1 then activates electromagnet 150 of the appropriate lower roadway 8 and randomly selects the current direction (or no current) so the subsurface vehicle 14 will randomly turn left, right or proceed straight through the intersection 82. When microprocessor first activates electromagnet 150, all stop coils 164 leading to intersection 82 are energized to block all traffic. After about 100 mseconds, the stop coil 164 of the lower roadway 8 on which the subsurface vehicle 14 to be controlled is located is deactivated by microprocessor U1 so that the subsurface vehicle 14 can enter intersection 82 to be guided by electromagnet 150. If more than one subsurface vehicle 14 is present at the intersection, microprocessor U1 commands them based on their order of arrival at intersection 82.

The above electromagnetic direction controllers of the present invention can be employed in a user control mode employing laser detector 160 and infrared sensor 162 of intersection 82, described above, to provide specific user command to allow a particular subsurface vehicle 14 to be guided in a specific direction through intersection 82. This user controlled mode operates substantially the same as the above random mode except that microprocessor U1 of FIG. 16 does not randomly energize electromagnet 150 of the subject lower roadway 8. Instead, microprocessor U1 follows the infrared command signals it has received from infrared sensor 162 to energize electromagnet 150 in the manner directed by the user to accomplish the desired direction of movement of subsurface vehicle 14. As in the above random mode, all stop coils 164 are first energized, with on subsequently opened. Also, commands are followed by microprocessor U1 in the order received.

Figure 16:
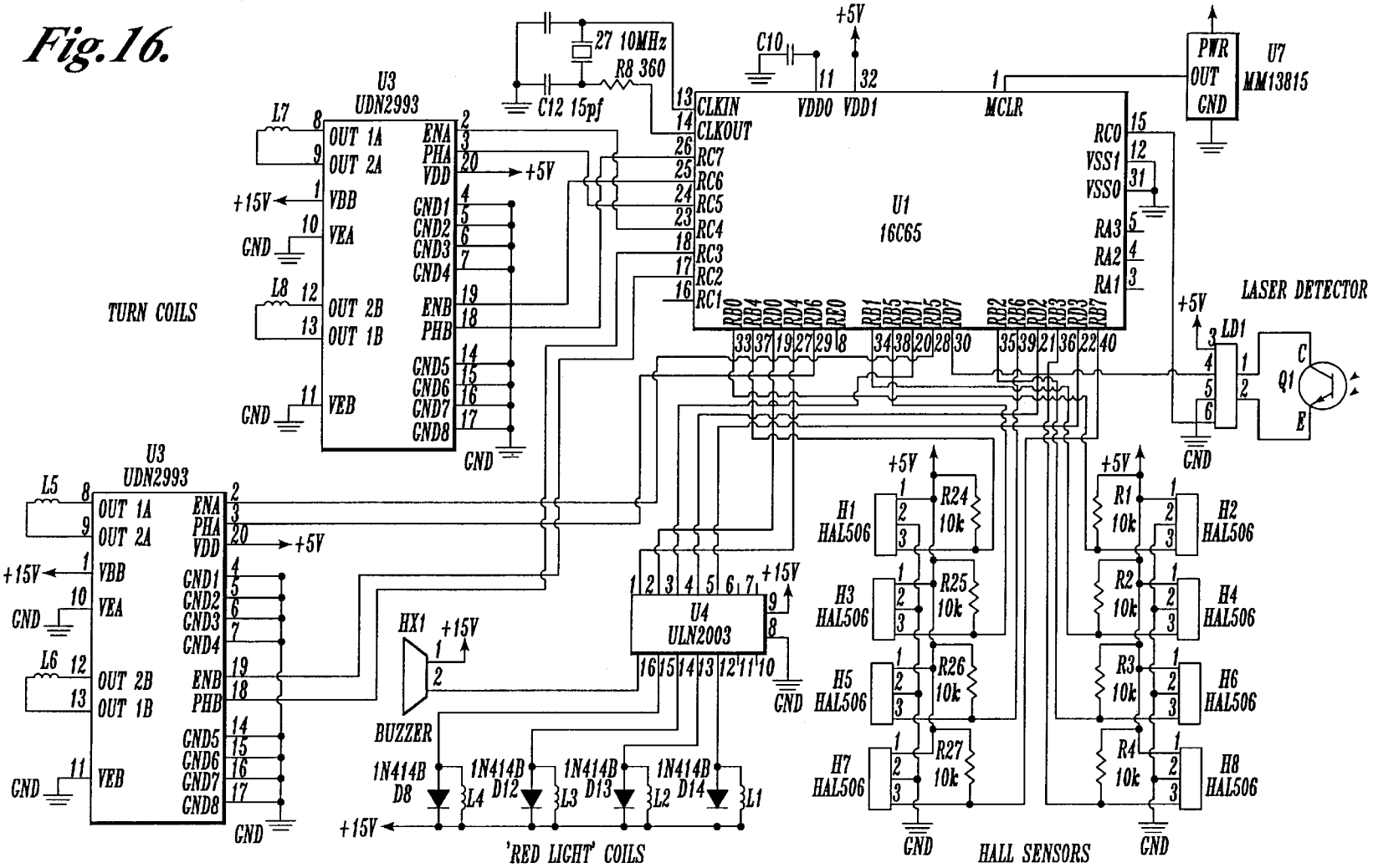
FIG. 16 is an electrical schematic of the guidance control electronics of the intersection of FIG. 12 of the present invention.

Next referring to FIG. 16, the electrical circuitry of the electromagnetic guidance control of intersection 82 is described. All logic functions are performed by an eight-bit microcontroller U1 (for example, model No. PIC16C65, manufactured by Microchip). Microcontroller U1 is clocked by a 10 MH quartz crystal X1, for example, model No. A143E manufactured by International Quartz Devices. Voltage monitor U7, for example, model No. 1381S manufactured by Panasonic, is responsible for the power-up reset and power supply fault protection. When the logic supply voltage (plus 5 V) drops below 4.2 V, the voltage detector drive LOW the MCLR pin of microcontroller U1, thus shutting it down to prevent it from operation at reduced power supply voltage. When the logic supply voltage (plus 5 V) is above 4.2 V, the voltage detector drive HIGH the MCLR pin of microprocessor U1, thus resetting it and reinitializing the system. Two full bridge drivers U5, for example, model No. UDN2903, manufactured by Allegro, drive electromagnets L5, L6, L7 and L8 (element 150 of FIGS. 13A and 13B) of intersection 82. When pin ENA of driver U5 is HIGH, the state of pin PHA determines the direction of the current through the selected electromagnet L5–L8, and thus the turn direction of a subsurface vehicle 14. When pin ENA of the full bridge driver U5 is LOW, no current flows through the selected electromagnet L5–L8 and the substrate vehicle 14 proceeds straight regardless of the state of pin PHA. Stop coils L1–L4 (element 164 of FIGS. 13A and 13B) are driven through Darlington array U4, for example, model No. ULN2003, manufactured by Motorola. Another channel of Darlington array U4 drives a buzzer or other sound device HN1, for example, model No. P9948 manufactured by Panasonic that provides user feedback for the hand-held remote control device. Hall effect sensors 166, described above, are designated H1–H4 and are, for example, model No. HAL506 manufactured by ITT Semiconductors. Hall effect sensors 166 sense when a subsurface vehicle enters intersection 82. Hall effect sensors 168 are designated H5–H8 in FIG. 16, sense when a subsurface vehicle leaves intersection 82, and are preferably the same model as Hall effect sensors H1–H4. When activated by side magnet 64 of a subsurface vehicle 14, Hall effects sensors H1–H8 drive LOW inputs RB4–RB8 of microcontroller U1, then denoting that a subsurface vehicle 14 has entered or left intersection 81. Since Hall effect sensors H1–H8 are open collector outputs, pull-up resistors R24–R27 are necessary to drive inputs of microprocessor U1 HIGH when no subsurface vehicle 14 is detected. Laser detector 160, described above, is denoted as LD1 and is connected directly to inputs of microprocessor U1 to provide input as to the desired electromagnetic configuration of intersection 82. The active level of laser detector LD1 is HIGH. Infrared sensor 162, denoted U6 in FIG. 16, for example, model No. TFM5300 manufactured by Temic, selects the route of subsurface vehicle 14 via the interface of the remote control. The information pertaining to the desired direction of subsurface vehicle 14 from the remote control interface is transmitted serially microprocessor U1 and is then decoded. The above circuit requires three power supply voltages: +5 V, +15 V, and the voltage of the subsurface vehicle 14 that is adjustable between +3 V and +6 V.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A combination guidance apparatus and movable toy vehicles comprising:

(a) a track having a first intersection;

(b) a first subsurface vehicle adapted to selectively traverse the track;

(c) a control unit;

(d) first and second magnetic means for guiding subsurface vehicles in alternate directions through intersections, the first magnetic means being responsive to the control unit and disposed within the first intersection and the second magnetic means being disposed with the first subsurface vehicle;

(e) magnetic means for stopping subsurface vehicles prior to entering the first intersection wherein said means for stopping is responsive to the control unit;

(f) means for actuating subsurface vehicles stopped at the first intersection after the first and second magnetic means for guiding subsurface vehicles has been actuated;

(g) a surface roadway located over the track; and (h) a first surface toy vehicle movable on the surface roadway in reaction to movement of the first subsurface vehicle.

2. The combination guidance apparatus and movable toy vehicles of claim 1, further comprising:

(a) a plurality of subsurface vehicles adapted to selectively traverse the track;

(b) a plurality of surface toy vehicles, wherein one of the plurality of surface toy vehicles being located above one of the plurality of subsurface vehicles and movable on the surface roadway in reaction to movement under the surface roadway of the respective one of the plurality of subsurface vehicles.

3. The combination guidance apparatus and movable toy vehicles of claim 2, further comprising:

(a) a motor in each subsurface vehicle; and (b) means for collision avoidance on each subsurface vehicle, the means for collision avoidance, comprising:

(i) a magnet on each subsurface vehicle; and (ii) a magnetic field sensor on each subsurface vehicle, the magnetic field sensor adapted to de-energize the motor of the associated subsurface vehicle when the magnetic field sensor senses a magnetic field of the magnet of another subsurface vehicle.

4. The combination guidance apparatus and movable toy vehicles of claim 2, further comprising means for remotely controlling the first magnetic means for guiding subsurface vehicles in alternate directions through intersections.

5. The combination guidance apparatus and movable toy vehicles of claim 2, wherein the control unit is preprogrammed to guide the subsurface vehicles based on predetermined variables.

6. The combination guidance apparatus and movable toy vehicles of claim 2, further comprising means for sensing one of the plurality of subsurface vehicles approaching or leaving the first intersection wherein said means for sensing is in communication with the control unit.

7. The combination guidance apparatus and movable toy vehicles of claim 6, wherein the means for sensing comprises a magnet on each of the subsurface vehicles and a magnetic field sensor adjacent the first intersection.

8. The combination guidance apparatus and movable toy vehicles of claim 2, wherein the first intersection having at least one magnet, the one magnet having reversible poles straddling a vehicle path.

9. The combination guidance apparatus and movable toy vehicles of claim 8, wherein each subsurface vehicle having a magnet.

10. The combination guidance apparatus and movable toy vehicles of claim 9, further comprising means for reversing current through the reversible poles to guide the subsurface vehicles by magnetic interaction with the magnets of the subsurface vehicles and wherein said means for reversing current is responsive to the control unit.

11. The combination guidance apparatus and movable toy vehicles of claim 10, further comprising means for remotely controlling the means for reversing current.

12. The combination guidance apparatus and movable toy vehicles of claim 11, wherein the control unit is preprogrammed based on predetermined variables.

13. A combination guidance apparatus and movable toy vehicles comprising:

(a) a track having a plurality of intersections;

(b) a first subsurface vehicle adapted to selectively traverse the track;

(c) a control unit;

(d) first and second magnetic means for guiding subsurface vehicles in alternate directions through intersections, the first magnetic means being responsive to the control unit and disposed within each of the plurality intersections and the second magnetic means being disposed with the first subsurface vehicle;

(e) magnetic means for stopping subsurface vehicles prior to entering any one of the plurality of intersections wherein said means for stopping is responsive to the control unit;

(f) means for actuating subsurface vehicles stopped at any one of the plurality of intersections after a predetermined time;

(g) a surface roadway located over the track; and (h) a first surface toy vehicle movable on the surface roadway in reaction to movement under the surface roadway of the first subsurface vehicle.

14. The combination guidance apparatus and movable toy vehicles of claim 13, further comprising:

(a) a plurality of subsurface vehicles adapted to selectively traverse the track;

(b) a plurality of surface toy vehicles, wherein one of the plurality of surface toy vehicles being located above one of the plurality of subsurface vehicles and movable on the surface roadway in reaction to movement under the surface roadway of the respective one of the plurality of subsurface vehicles.

15. The combination guidance apparatus and movable toy vehicles of claim 14, further comprising:

(a) a motor in each subsurface vehicle; and (b) means for collision avoidance on each subsurface vehicle, the means for collision avoidance, comprising:

(i) a magnet on each subsurface vehicle; and (ii) a magnetic field sensor on each subsurface vehicle, the magnetic field sensor adapted to de-energize the motor of the associated subsurface vehicle when the magnetic field sensor senses a magnetic field of the magnet of another subsurface vehicle.

16. The combination guidance apparatus and movable toy vehicles of claim 14, further comprising means for remotely controlling the first magnetic means for guiding subsurface vehicles in alternate directions through intersections.

17. The combination guidance apparatus and movable toy vehicles of claim 14, wherein the control unit is preprogrammed to guide the subsurface vehicles based on predetermined variables.

18. The combination guidance apparatus and movable toy vehicles of claim 14, further comprising means for sensing one of the plurality of subsurface vehicles approaching or leaving any one of the plurality of intersections wherein said means for sensing is in communication with the control unit.

19. The combination guidance apparatus and movable toy vehicles of claim 18, wherein the means for sensing comprises a magnet on each one of the plurality of subsurface vehicles and a magnetic field sensor adjacent each one of the plurality of intersections.

20. A combination guidance apparatus and movable toy vehicles comprising:

(a) a track having a plurality of intersections;

(b) a first subsurface vehicle adapted to selectively traverse the track and selectively stop at any one of the plurality of intersections;

(c) a control unit;

(d) first and second magnetic means for guiding subsurface vehicles in alternate directions through intersections, the first magnetic means being responsive to the control unit and disposed within each of the plurality intersections and the second magnetic means being disposed with the first subsurface vehicle;

(e) means for sensing subsurface vehicle presence in any one of the plurality of intersections wherein said means for sensing is in communication with the control unit;

(f) means for actuating subsurface vehicles stopped at any one of the plurality of intersections after the means for sensing subsurface vehicle presence in any one of the plurality of intersection senses no subsurface vehicles in the intersection;

(g) a surface roadway located over the track; and (h) a first surface toy vehicle movable on the surface roadway in reaction to movement under the surface roadway of the first subsurface vehicle.

21. The combination guidance apparatus and movable toy vehicles of claim 20, further comprising:

(a) a plurality of subsurface vehicles adapted to selectively traverse the track;

(b) a plurality of surface toy vehicles, wherein one of the plurality of surface toy vehicles being located above one of the plurality of subsurface vehicles and movable on the surface roadway in reaction to movement under the surface roadway of the respective one of the plurality of subsurface vehicles.

22. The combination guidance apparatus and movable toy vehicles of claim 21, further comprising:

(a) a motor in each substrate vehicle; and (b) means for collision avoidance on each subsurface vehicle, the means for collision avoidance, comprising:

(i) a magnet on each subsurface vehicle; and (ii) a magnetic field sensor on each subsurface vehicle, the magnetic field sensor adapted to de-energize the motor of the associated toy vehicle when the magnetic field sensors senses a magnetic field of the magnet of another subsurface vehicle.

23. The combination guidance apparatus and movable toy vehicles of claim 21, further comprising means for remotely controlling the first magnetic means for guiding subsurface vehicles in alternate directions through intersections.

24. The combination guidance apparatus and movable toy vehicles of claim 21, wherein the control unit is preprogrammed to guide the subsurface vehicles based on predetermined variables.

25. The combination guidance apparatus and movable toy vehicles of claim 21, wherein the means for sensing comprises a magnet on each one of the plurality of subsurface vehicles and a magnetic field sensor adjacent each one of the plurality of intersections.

* * * * *

UNITED STATES PATENT AND TRADEMARK OFFICE

CERTIFICATE OF CORRECTION

PATENT NO. : 6,322,415 B1
DATED : November 27, 2001
INVENTOR(S) : P. Cyrus et al.

It is certified that error appears in the above-identified patent and that said Letters Patent is hereby corrected as shown below:

Title page,
Item [73], Assignee, insert in appropriate order the following:
-- [73] Assignee: Parvia Corporation, Seattle, WA (US) --

Item [74], *Attorney, Agent, or Firm* insert in appropriate order the following:
-- [74] *Attorney, Agent, or Firm* -- Christensen O'Connor
Johnson Kindness PLLC --

Column 10,
Line 53, "track;" should read -- track; and --
Line 64, "avoidance, comprising:" should read -- avoidance comprising: --

Column 11,
Line 51, "plurality intersections" should read -- plurality of intersections --
Line 67, "track;" should read -- track; and --

Column 12,
Line 11, "avoidance, comprising:" should read -- avoidance comprising: --
Line 48, "plurality intersections" should read -- plurality of intersections --
Line 56, "plurality of intersection" should read -- plurality of intersections --
Line 65, "track;" should read -- track; and --

UNITED STATES PATENT AND TRADEMARK OFFICE

CERTIFICATE OF CORRECTION

PATENT NO. : 6,322,415 B1
DATED : November 27, 2001
INVENTOR(S) : P. Cyrus et al.

It is certified that error appears in the above-identified patent and that said Letters Patent is hereby corrected as shown below:

Column 13,
Line 9, "avoidance, comprising:" should read -- avoidance comprising: --
Line 15, "sensors senses" should read -- sensor senses --

Signed and Sealed this

Twenty-seventh Day of August, 2002

*Attest:*

*Attesting Officer*

JAMES E. ROGAN
*Director of the United States Patent and Trademark Office*